US008282131B2

(12) United States Patent
Karlöf et al.

(10) Patent No.: US 8,282,131 B2
(45) Date of Patent: Oct. 9, 2012

(54) SKI POLE

(75) Inventors: Lars Karlöf, Hagan (NO); Svein Pedersen, Askim (NO); Elise Reiten, Bærums Verk (NO)

(73) Assignee: Swix Sport AS, Kjelsàs (NO)

( * ) Notice: Subject to any disclaimer, the term of this patent is extended or adjusted under 35 U.S.C. 154(b) by 227 days.

(21) Appl. No.: 12/898,738

(22) Filed: Oct. 6, 2010

(65) Prior Publication Data

US 2011/0084471 A1 Apr. 14, 2011

(30) Foreign Application Priority Data

Oct. 9, 2009 (NO) ..... 20093125

(51) Int. Cl.
*A63C 11/22* (2006.01)

(52) U.S. Cl. ..... 280/819

(58) Field of Classification Search ..... 280/819–824; 428/34.1

See application file for complete search history.

(56) References Cited

U.S. PATENT DOCUMENTS

| | | | | | |
|---|---|---|---|---|---|
| 3,596,921 | A * | 8/1971 | Bruckl | ..... | 280/819 |
| D304,608 | S * | 11/1989 | Filice | ..... | D21/775 |
| 5,348,346 | A * | 9/1994 | Unger | ..... | 280/819 |
| 5,505,492 | A * | 4/1996 | Nelson et al. | ..... | 280/819 |
| 5,534,203 | A * | 7/1996 | Nelson et al. | ..... | 264/101 |
| 5,611,571 | A * | 3/1997 | Manninen et al. | ..... | 280/819 |
| 5,755,826 | A * | 5/1998 | Beach et al. | ..... | 473/316 |
| 6,286,244 | B1 * | 9/2001 | Weiss | ..... | 43/18.1 R |
| 2003/0022716 | A1 | 1/2003 | Park et al. | | |
| 2003/0227167 | A1 * | 12/2003 | Redor et al. | ..... | 280/819 |
| 2007/0108756 | A1 * | 5/2007 | Laakso et al. | ..... | 280/823 |
| 2007/0120352 | A1 * | 5/2007 | Panizza | ..... | 280/819 |
| 2011/0084472 | A1 * | 4/2011 | Karlof et al. | ..... | 280/824 |

FOREIGN PATENT DOCUMENTS

| | | | |
|---|---|---|---|
| DE | 29620816 | U1 * | 1/1997 |
| NO | 300032 | | 8/1995 |
| SU | 1782173 | | 12/1992 |

* cited by examiner

*Primary Examiner* — Hau Phan
*Assistant Examiner* — Jacob Meyer
(74) *Attorney, Agent, or Firm* — Christian D. Abel

(57) ABSTRACT

The present invention concerns a ski pole. More specifically, the invention is directed to an aerodynamically favorable ski pole, which is designed to allow glue less or adhesive less directionally controllable fixation of replaceable means for limiting the sinking of the ski pole into ground surfaces.

8 Claims, 1 Drawing Sheet

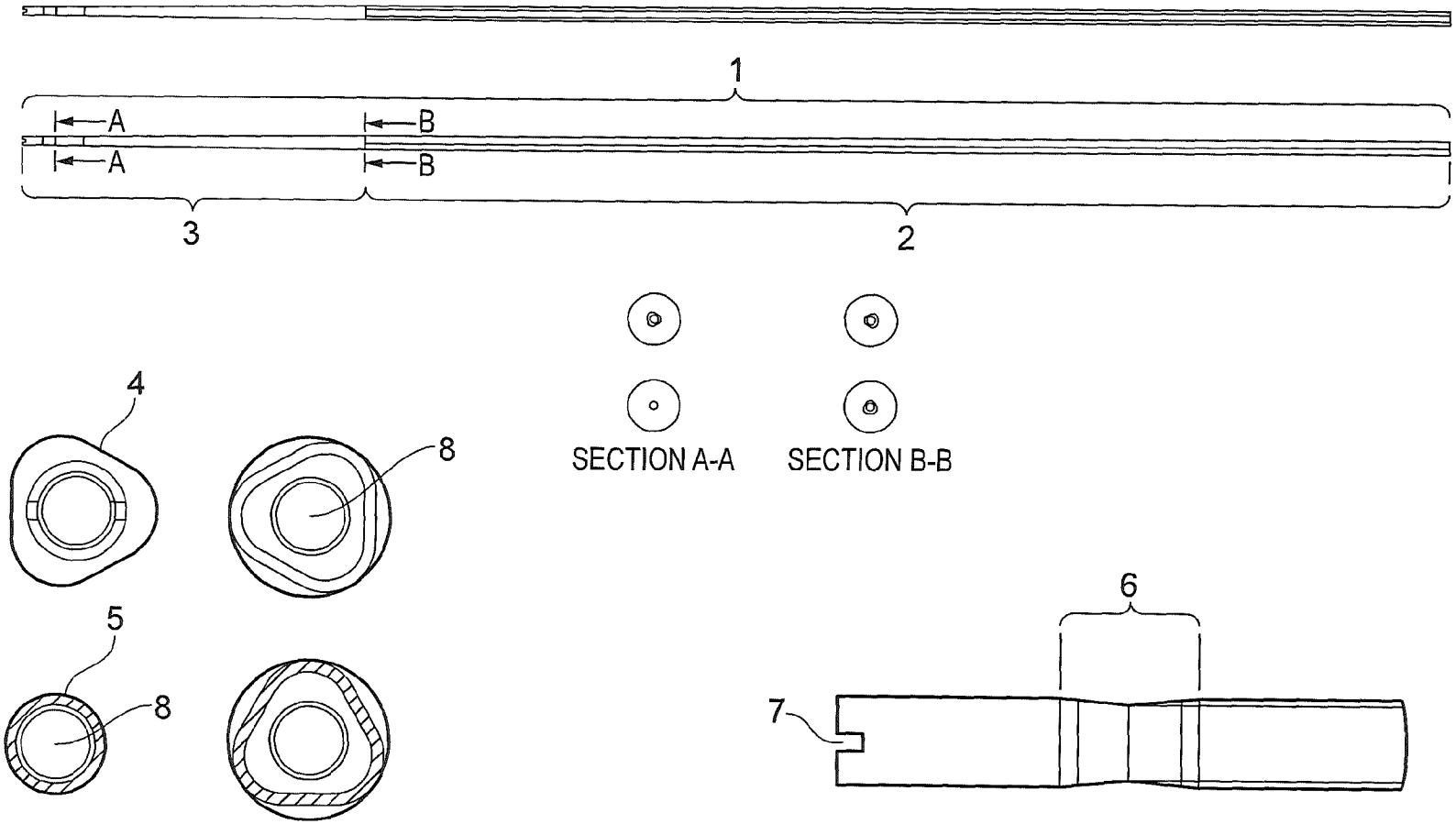
1
2
3
A
A
B
B
SECTION A-A
SECTION B-B
4
5
6
7
8
8

SKI POLE

FIELD OF INVENTION

The present invention concerns a ski pole. More specifically, the invention is directed to an aerodynamically favorable ski pole.

BACKGROUND OF THE INVENTION

Hand held ski poles have been used together with skies for centuries, primarily for helping the skier maintain balance when skiing, but also to help the skier get traction for movement in a forward direction. When modern skiing was in its infancy almost 200 years ago, a single pole was often used. However, in modern skiing two poles are used both for downhill and cross country skiing.

As modern skiing is constantly developing, focus is put on the development of new and improved skiing equipment to further advance the sport. Ski poles have been transformed fundamentally from the single pole of the $19^{th}$ century to the light weight versions of today, when the skier carries one pole in each hand.

Traditionally, the typical cross country ski pole, and also the downhill versions of the poles, has been a circular hollow tube fitted with a handle, a disc or a snow guard for keeping the pole from sinking too far into the snow, and a spike in the bottom end to ensure traction. This is more or less still the general design of a modern ski pole of today. However, as the sport of skiing is constantly developing, there is a constant search and demand for improved solutions to provide new ski poles which are better suited to the sport of skiing.

Thus, the object of the present invention is to provide a ski pole which is better suited to modern skiing than the ski poles known from the field. This is achieved by the ski pole as claimed in the present application.

Relevant prior art is disclosed in SU 1782173 A3, NO 300032 B1, US 2003/0227167 A1, and US 5505492 A1.

SHORT DESCRIPTION OF THE FIGURES

FIG. 1 illustrates one embodiment of the ski pole according to the invention, wherein the ski pole 1 in one section 2 has a triangular cross section 4, and wherein in the other section 3, the cross section is circular 5; and wherein section 3 comprises a diameter distorted section 6 and a slot 7; and wherein the ski pole is hollow, or has a hollow core 8.

DETAILED DISCLOSURE OF THE INVENTION

In one embodiment, the present invention concerns a ski pole 1, in which the cross section of said pole in one end is triangular 2, and in which the cross section of said pole in the opposite end is circular 3; the cross section of said pole gradually adopting a triangular 4 or circular 5 cross section moving along the ski pole from one end to the opposite end. Preferably, the top end of the ski pole has a triangular 4 cross section, and the bottom end of the ski pole has a circular 5 cross section.

In another embodiment, the ski pole 1 according to the invention may be one wherein the outer diameter of said pole is gradually decreasing from one end towards the other end of the pole. The ski pole of the invention may also have its greatest outer diameter at a point between the two ends of said ski pole.

In yet another embodiment, the ski pole 1 according to the invention may have its greatest outer diameter in the triangular cross sectional end 2; and the outer diameter of the ski pole may be gradually decreasing from the far end of this triangular cross sectional end 2 of the ski pole towards the circular cross sectional end 3 of the ski pole of the invention.

In another embodiment, the ski pole 1 according to the invention may be hollow. The ski pole of the invention may also be produced with a hollow core 8. In a more specific embodiment, the cross section of the hollow core 8 may be circular over the total length of the ski pole 1 of the invention. However, the hollow core 8 may have other geometrical cross sectional shapes over the length of the ski pole of the invention, such as rhomboid, triangular, rectangular, square, pentameric, hexameric etc., or a combination of any such geometrical shape.

In a further embodiment of the ski pole 1 according to the invention, at a distance from one end of the ski pole, the pole may comprise a section 6 with a slightly distorted diameter compared to the section immediately preceding and following said diameter distorted section 6. Preferably, this diameter distorted section 6 may be located at a distance from the bottom end of the ski pole, in the end of the ski pole having a circular cross section 3. This diameter distorted section 6 may function as a friction increasing feature to enhance fixation of a replaceable means for limiting the sinking of the ski pole into ground surfaces, such as a disc structure or a snow guard, when the ski pole is used for skiing or walking.

In one embodiment, the diameter distorted section 6 may have a length along the ski pole of about 5-40 mm, more preferably about 10-30 mm, and most preferably about 15-25 mm. The diameter distorted section 6 may be placed about 10-40 mm from one end of the ski pole of the invention, more preferably about 20-30 mm from one end, and most preferably about 22-28 mm from one end of the ski pole of the invention.

The diameter distorted section 6 of the above embodiments is primarily a feature which is designed to enhance friction when a stopper means is used to firmly fix a replaceable means for limiting the sinking of the ski pole into ground surfaces, such as a disc structure or a snow guard. The stopper, which is designed to be compatible with the replaceable means for limiting the sinking of the ski pole into ground surfaces, is aided in its stopper function by the enhanced friction of the diameter distorted section 6. Preferably, the diameter distorted section 6 may have a cross sectional diameter less than the cross sectional diameters of the sections immediately preceding and following said diameter distorted section 6. However, the diameter distorted section 6 may have a cross sectional diameter which is greater than the cross sectional diameters of the sections immediately preceding and following said diameter distorted section 6.

In a further embodiment of the ski pole of the invention 1, the ski pole may further be configured with features for securing attachment and correct positioning of an unsymmetrical replaceable means for limiting the sinking of the ski pole into ground surfaces, such as a disc structure or a snow guard, in a desired direction relative to the shape of the ski pole. In a preferred embodiment of the invention, this feature for securing attachment in a desired direction of such unsymmetrical means may be a slot 7 placed diametrically across the circular cross sectional end 3 of the ski pole. This slot 7 may also be place slightly off centre, or it may be placed off centre to such a degree that the slot is a recess. The slot 7 may preferably be about 1-10 mm deep, more preferably 2-8 mm deep, and most preferably 3-6 mm deep. However, it is contemplated that the slot 7 of this preferred embodiment may be replaced with other features for achieving the same result, such as one or more lips on the ski pole in the same area as the slot, or along the side of the ski pole in this area. It is also possible to achieve the same result with two or more slots.

In another embodiment of the ski pole 1 of the invention, the ski pole may have incorporated means for enhancing the grip of the pole onto ground surfaces. This may be achieved by fitting the ski pole with a spike structure in the end of the ski pole facing the ground when it is used for skiing or walking. The spike structure may be formed from any material which provides the material strength necessary for providing a grip on the desired surface.

The ski pole of the present invention has the following advantages over the prior art. Firstly, by the substantially triangular shape of the ski pole of the invention, the ski pole avoids the problem of the pole being forced out of a strictly forward directed motion, relative to the direction of the skier holding the ski pole. Traditional tube formed or elliptic formed ski poles produce a drag and/or a lift when the skier push them forward into a pendulum movement; and this drag/lift causes the ski pole to wander off to either left or right. This drag forced deviation from a strict pendulum movement has the effect that the skier must use unnecessary force to correct the trajectory of the ski pole into a strictly forward directed motion. For the athlete cross country skier, this is of course a major disadvantage over a set distance, because this unnecessary extra force does not contribute to the skier's forward motion. Moreover, for the downhill skier, a ski pole that behaves like an aero plane wing makes the ski pole unstable, which may cause the ski pole to interfere with the skier by behaving unpredictably. The substantially triangular cross sectional shape of the ski pole of the invention also requires less material to be used for the production of the pole as compared to a ski pole with a circular cross section. The ski pole of the present invention will as a consequence have less weight than a corresponding substantially circular cross sectional ski pole made of the same material.

As mentioned above, the ski pole of the present invention, by its substantially triangular shape, avoids this problem by reducing the drag forces when the ski pole is used for skiing. By placing a handle on top of the ski pole in the correct orientation relative to the cross sectional shape of the ski pole, the ski pole is arranged with one of the three sides of the triangular shape of the pole facing directly forward into the direction of movement of the skier holding the ski pole of the invention. Surprisingly, this orientation of the triangular ski pole of the invention has proved significantly advantageous in reducing drag. A skier using the ski pole of the invention does not experience the need to use extra and unnecessary effort to force the ski pole into a strictly forward directed pendulum motion, because the ski pole of the invention, by its novel features, does not require a correction of trajectory.

A second advantage of the ski pole of the invention is the gradually reduced cross sectional area towards the bottom end of the ski pole. When a ski pole is used for cross country skiing, the bottom end is moved forward by the skier in a pendulum movement. Thus, this end of the ski pole has the greatest angular speed when used for skiing. By the laws of physics; the more weight concentrated in this end of the ski pole, the more force is required by the skier to move it forward. Consequently, it is paramount to reduce the weight in this end of the ski pole as much as possible to minimize the force necessary to move the ski pole forward in a pendulum movement. This is achieved by the shape of the ski pole of the invention, which gradually adopts a circular cross section towards the bottom end of the ski pole. This feature allows less material to be used in this end of the ski pole, and consequently, the weight of the bottom end of the ski pole of the invention is kept low.

A third advantage of the ski pole of the invention is that it is designed to allow glue less or adhesive less fixation of replaceable means for limiting the sinking of the ski pole into ground surfaces, such as a disc structure or a snow guard. Traditionally, ski poles are fitted with a disc or snow guard to prevent the ski pole from sinking too far into the snow. One pair of ski poles is usually manufactured with one type of disc or ski guard, and these are glued or otherwise firmly fixed to the ski pole. That is, commercial ski poles are sold with a disc or a snow guard which cannot easily be replaced. The ski pole of the present invention is designed to be fitted with different replaceable means for limiting the sinking of the ski pole into ground surfaces, such as symmetrical or unsymmetrical discs or snow guards, without the need of using a glue or adhesive. In addition, the ski pole of the invention, by its novel features, makes it possible to correctly fix an unsymmetrical disc or snow guard to the ski pole such that the unsymmetrical disc or snow guard is orientated correctly relative to the intended direction of the motion of the ski pole when this is used by a skier.

At first hand, it might not seem like a decisive advantage to have glue less fixation of a disc or snow guard system onto a ski pole. However, for athlete skiers, a reduced weight of the equipment they are using in a competition situation is welcome and necessary in order to gain an advantage over their competitors. In this way, the elimination of the need for a glue or adhesive in the ski pole of the invention is fully in line with the object of the invention, which is to provide a light weight aerodynamically favorable ski pole. Moreover, to eliminate the need for using a glue or adhesive in the bottom part of the ski pole of the invention, which as explained above is the part of the ski pole having the greatest angular speed, has a far greater influence on the force required to operate the ski pole by the skier than the few grams lost would initially seem to the untrained eye. This is because the skier operates and applies force to the ski pole from the top end in order to move the bottom end into a pendulum movement. Thus, the weight moved is not just the mass of the bottom end, but the mass of the bottom end in relation to the length of the pole. For the skier, this experienced weight is bigger, and, any reduction of weight in the bottom en of the ski pole reduces the force necessary to operate the ski pole far more than the lost weight would mean in pure weight.

In addition, the possibility to replace the means for limiting the sinking of the ski pole into ground surfaces, such as a disc or snow guard system, whenever this is desired by the skier, provides another advantage for the ski pole of the invention. This allows the skier to easily replace the disc or ski guard system in accordance with the consistency of the snow. The skier is then in a position to always ensure that a disc or snow guard system with as little weight as possible is used for the ski pole of the invention.

Consequently, the three major advantages of the ski pole of the invention, i.e., the aerodynamically favorable shape, the elimination of glue or adhesive to fix the replaceable means for limiting the sinking of the ski pole into ground surfaces and the possibility to replace the means for limiting the sinking of the ski pole into ground surfaces, all contribute to the object of the invention, which is to provide a favorable ski pole better suited to modern skiing than the ski poles known from the field. The ski pole of the invention may be used in cross country skiing, downhill skiing, rollerblading or roller skiing and for walking.

The invention claimed is:

1. A ski pole, comprising a pole having a triangular cross section at a first end, and a circular cross section at a second end, the cross section of said pole gradually transitioning from triangular to circular cross section moving along the ski pole from the first to the second end, and wherein at a distance from one end of said pole, there is a section of the pole with a slightly distorted diameter compared to the sections immediately adjacent said distorted diameter section of said pole.

2. The ski pole according to claim 1, wherein said distorted diameter section is localized on the circular cross sectional part of said ski pole.

3. The ski pole according to claim 1 wherein the outer diameter of said pole is gradually decreasing from one end towards the other end of the pole.

4. The ski pole according to claim 3, wherein the outer diameter of the pole is decreasing from the triangular cross sectional end towards the circular cross sectional end of said pole.

5. The ski pole according to either of claims 1-4, wherein said ski pole further comprises means for securing attachment and correct positioning of a disc or ski guard system in a desired direction relative to the shape of said ski pole.

6. The ski pole according to claim 5, wherein said means for securing attachment of a disc in a desired direction is at least one slot placed diametrically across one end of said pole.

7. The ski pole according to claim 5, wherein the pole is hollow.

8. The ski pole according claim 5, wherein means for enhancing the grip of the pole onto ground surfaces is incorporated at one end of the pole.

* * * * *